US012480298B2

(12) United States Patent
Stammel et al.

(10) Patent No.: US 12,480,298 B2
(45) Date of Patent: Nov. 25, 2025

(54) SANITARY FURNITURE TO BE HUNG ON THE WALL

(71) Applicant: Duravit Aktiengesellschaft, Hornberg (DE)

(72) Inventors: Thomas Stammel, Hornberg (DE); Ulrich Weber, Haslach (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 205 days.

(21) Appl. No.: 18/239,420

(22) Filed: Aug. 29, 2023

(65) Prior Publication Data

US 2024/0076864 A1 Mar. 7, 2024

(30) Foreign Application Priority Data

Sep. 6, 2022 (DE) ..... 10 2022 122 602.6

(51) Int. Cl.
*E03C 1/322* (2006.01)
*A47B 88/40* (2017.01)

(52) U.S. Cl.
CPC ..... *E03C 1/322* (2013.01); *A47B 88/402* (2017.01); *A47B 2220/03* (2013.01)

(58) Field of Classification Search
CPC ... E03C 1/322; A47B 88/402; A47B 2220/03; A47B 88/43; A47B 67/04; A47B 95/008
USPC ..... 4/648, 643
See application file for complete search history.

(56) References Cited

U.S. PATENT DOCUMENTS

| | | | | |
|---|---|---|---|---|
| 9,808,127 | B2 * | 11/2017 | Leichsenring | A47B 57/32 |
| 11,268,269 | B2 * | 3/2022 | Stammel | A47B 88/906 |
| 11,268,289 | B2 | 3/2022 | Stammel | |
| 2016/0235255 | A1 * | 8/2016 | Leichsenring | A47C 11/00 |
| 2018/0249834 | A1 * | 9/2018 | Marks | A47B 88/956 |

FOREIGN PATENT DOCUMENTS

| | | | | |
|---|---|---|---|---|
| AU | 2020399159 | A1 * | 8/2022 | A47K 1/05 |
| CN | 208693108 | U * | 4/2019 | |
| DE | 102006029801 | A1 | 1/2008 | |

(Continued)

OTHER PUBLICATIONS

German Office Action Dated May 23, 2023, 6 Pages.

(Continued)

*Primary Examiner* — Lori L Baker
(74) *Attorney, Agent, or Firm* — LUCAS & MERCANTI, LLP; Klaus P. Stoffel

(57) ABSTRACT

A wall-mounted bathroom furniture, including a supporting structure with a support component to be fastened to a vertical wall and multiple support elements arranged offset horizontally to one another on the support component, projecting horizontally from the support component in cantilever fashion. Linear guides for receiving at least one extendable drawer are provided on the support elements or on at least some of the support elements. At least one drawer with a base, two side walls and a front wall is placed, or can be placed, on the linear guides arranged below the base. The support elements, or at least some of the support elements, are designed either to receive a countertop to be arranged horizontally, for receiving a washbasin, or for directly receiving a washbasin.

14 Claims, 8 Drawing Sheets

(56) References Cited

FOREIGN PATENT DOCUMENTS

| | | | | | |
|---|---|---|---|---|---|
| DE | 202017004626 | U1 | | 9/2017 | |
| DE | 102019114279 | A1 | | 12/2020 | |
| GB | 2570337 | A | * | 7/2019 | ..... A47B 88/402 |
| WO | WO-2021161055 | A1 | * | 8/2021 | ..... A47B 96/06 |
| WO | WO-2024078940 | A1 | * | 4/2024 | ..... A47B 88/42 |

OTHER PUBLICATIONS

European Search Report Dated Jan. 12, 2024 2 Pages.
Candian Report for Application No. 3,211,157 Dated Jan. 9, 2025, 6 Pages.

* cited by examiner

SANITARY FURNITURE TO BE HUNG ON THE WALL

CROSS-REFERENCE TO RELATED APPLICATIONS

The present application claims priority of DE 10 2022 122 602.6, filed Sep. 6, 2022, the priority of this application is hereby claimed, and this application is incorporated herein by reference.

BACKGROUND OF THE INVENTION

The invention relates to wall-mounted bathroom furniture.

This kind of bathroom furniture is regularly used as a base unit for a washbasin which is placed on top of the bathroom furniture. A distinction is made between vanity washbasins, in which the washbasin placed on top of the bathroom furniture defines the entire top of the bathroom arrangement formed by the bathroom furniture and the washbasin, and console washbasins, in which the bathroom furniture comprises a countertop, or a countertop is placed on top, onto which the washbasin is then placed, so that the top of the furniture is formed both by the countertop and the washbasin.

In addition to the floor-standing arrangement of this kind of bathroom furniture, a wall-mounted arrangement is also known in the art. For this purpose, the bathroom furniture is normally fastened to the wall using mounting brackets. This involves a first bracket being mounted on the wall to begin with, after which a corresponding second bracket or a counterpart is attached to a body of the bathroom furniture and hung. A disadvantage of this kind of hanging installation is that it can be unwieldy when large, wide pieces of bathroom furniture are involved, as the weight has to be held during the process of hanging the mounting brackets, something that is sometimes not particularly easy.

Typically, when configured as drawer furniture, bathroom furniture consists of a body in which one or multiple drawers are mounted on slides. A drawer is either self-closing, meaning that the drawer front is located completely within the body and does not protrude, or it is pivot-opening, meaning that the drawer front sits on the front of the body. The assembly of a drawer of this kind in the body has the disadvantage that the entire width of the furniture cannot be utilized, as not only the width of the drawer frame, but also the width of the body walls, is subtracted from the usable storage space.

Frameless bathroom furniture is known from DE 10 2019 114 279 A1. This bathroom furniture comprises a supporting structure with two vertical supports which must be provided on the wall side, to which two support panels arranged horizontally to the front, i.e. below the washbasin, are fastened, which support panels in turn have linear guides on which the two drawers provided there are arranged. The storage space is slightly larger compared with typical cased furniture; however, it is limited by the large-area and correspondingly generously sized horizontal panels, on which the linear guides and slides, respectively, are arranged.

SUMMARY OF THE INVENTION

The invention is based on the problem of specifying bathroom furniture that is an improvement on this.

To solve this problem, wall-mounted bathroom furniture is provided according to the invention, comprising:

a supporting structure with a support component to be fastened to a vertical wall and multiple support elements arranged offset horizontally to one another on the support component, projecting horizontally from said support component in cantilever fashion, wherein linear guides for accommodating at least one extendable drawer are provided on the support elements or on at least some of the support elements, at least one drawer with a base, two side walls and a front wall that is placed, or can be placed, on the linear guides arranged below the base, wherein the support elements, or at least some of the support elements, are designed either to receive a countertop to be arranged horizontally, for receiving a washbasin, or for directly receiving a washbasin.

The frameless bathroom furniture according to the invention to be arranged in wall-mounted fashion is characterized by a very simple supporting structure which, on the one hand, is capable of receiving the at least one drawer and guiding it across linear guides and, on the other hand, is capable of receiving the washbasin itself or a console-like countertop along with the washbasin. For this purpose, the supporting structure comprises a support component to be arranged on an adjacent building wall, which support component may, for example, be a support panel made of wood or a wood-based material or plastic or the like. This one single support component is fastened on the wall side. At least two support elements are arranged on the support component, possibly also more than two, wherein these support elements are spaced horizontally from one another, in other words arranged in the region of the right and left side edges of the support component, for example. The support elements, which may be configured as simple angle elements, for example, as will be explained in further detail below, extend horizontally forwards from the support component, in other words, the support panel, for example. At least two linear guides are arranged on the support elements, via which the at least one drawer is received and guided. This means that the support elements serve not only to hold the linear guide, on the one hand, but also to support the drawer, on the other. Furthermore, the at least two support elements or, if more than two such support elements are provided, some of these support elements, are set up either to receive the washbasin directly, in the case of a vanity washbasin, or a countertop or console and the washbasin, in the case of a console washbasin. This means that the corresponding interfaces are made available through the separate support elements, which are simple and can have correspondingly narrow dimensions and on which the drawer, on the one hand, and the washbasin or the countertop along with the washbasin, on the other hand, are arranged.

It follows from this that a very simple and rather delicate supporting structure is obtained which occupies very little space frontwards because the separate support elements, as described, can have correspondingly narrow dimensions, in both horizontal and vertical directions. These support elements are preferably simple metal components that inherently possess sufficient stability to receive and support the corresponding weights of the drawer, washbasin, etc. In particular, a metal construction allows for a particularly narrow design of these support elements.

Due to the correspondingly compact and space-saving design of the supporting structure, there is ample space available in front of the support component and therefore below the washbasin, which space can be optimally utilized via the at least one drawer or multiple drawers. Since the bathroom furniture according to the invention is frameless, the drawer front and drawer sides therefore create the corresponding visible surfaces, thereby defining the outward appearance of the bathroom furniture to the front and to the sides. Consequently, the linear guides onto which the drawer base is placed are corresponding underfloor slides, which can also have correspondingly narrow dimensions and are out of sight.

For easy installation, the support component may have at least two openings for receiving lag screws that are to be fastened on the wall side. This type of fastening for the support component, in other words, the support panel, for example, is very straightforward. Only a minimum of two lag screws need to be screwed into corresponding holes on the wall side, which lag screws are guided through the corresponding openings on the support component side, after which corresponding nuts are screwed onto the lag screws to secure the attachment. It is preferable for the openings to be oversized, allowing for the support component to be aligned before the final tightening. In particular, lateral alignment should be possible, for which purpose the openings are preferably designed as elongated holes, which may also have a slight oversize in the vertical direction, however.

The support component may be configured as a metal rail, for example, on which the corresponding support elements are arranged, wherein this metal rail may also have vertical extension sections if multiple support elements have to be arranged in a vertically offset manner, in order to receive two drawers, for example. With this design, no provision needs to be made for routing the water supply and drainage pipes towards the wall, on account of the rail-like configuration. Alternatively, a corresponding support panel can also be used, preferably right-angled in shape and of corresponding dimensions, depending on whether one or, for example, two drawers are to be provided. As this is a panel-shaped part, a corresponding opening for routing the water supply and drainage pipes should be provided in this case.

In order to simplify the wall-side installation of the supporting structure as far as possible and to ensure horizontal alignment, a particularly expedient development of the invention envisages that when the support component is configured as a support panel, an elongate opening or depression extending horizontally in relation to the assembly position, for receiving a guide rail to be fastened on the wall side, is provided, on which the support panel sits in the assembly position. The assembly kit or the bathroom furniture also comprises a guide rail which is fixed on the wall side by means of suitable fastening screws. It is fastened in such a manner that it ideally runs horizontally. When the supporting structure is to be installed, it must be lifted and can, with the engagement of the guide rail, be placed in the opening or recess on said guide rail. Consequently, in the context of the subsequent alignment and installation, during which the nuts are screwed onto the lag screws, etc., the guide rail supports the weight of the supporting structure, meaning that it does not need to be held permanently. Moreover, once the guide rail is aligned exactly horizontally, it is also ensured that the supporting structure is precisely horizontally aligned, eliminating the need for further work in this regard. Only lateral alignment may be necessary, which can be achieved through simple lateral displacement on the guide rail.

A central feature of the supporting structure is the support elements that carry or support the linear guides and the drawer and washbasin, respectively. As previously explained, they should be designed to be as narrow as possible, so that they occupy as little space as possible, since they extend horizontally forwards. In order to facilitate this, each support component according to the invention may have a panel-shaped fastening section for connection to the support component, as well as a support arm extending perpendicularly from the fastening section to receive a linear guide or the countertop or the washbasin. The fastening panel provides a correspondingly sized fastening interface in terms of area for connecting each support element to the support component, such as the support panel, for example. This panel-shaped fastening section may have multiple openings for receiving suitable connecting screws, with which the support element is screwed to the support component. At the same time, the panel-shaped design provides a correspondingly large support surface, ensuring that the parts being received are adequately supported and preventing tilting. A corresponding support arm extends perpendicularly from the fastening section, wherein this support arm is designed to receive the linear guides and the countertop, respectively, or the washbasin, depending on the specific purpose of the support element. As mentioned, this support arm may have the narrowest possible design, in particular when the support element is made of metal, so that it occupies a small amount of space.

In a further development of the invention, the support arm in each case is preferably L-shaped in cross section. Consequently, it has two corresponding arm legs that run perpendicularly to one other and may, for example, have the same width. This design is particularly advantageous, in that a support component of this kind can be used for various purposes. If the support component is intended to receive linear guides, it can be arranged in such a manner that the one arm leg runs horizontally, while the other arm leg runs vertically upwards. A linear guide is placed on the horizontal arm leg; the vertical arm leg runs directly beneath the drawer base. If the support element is to be used to receive the washbasin or countertop, the identical support element is mounted in a position rotated through 90°. In this case, the one support arm leg runs horizontally, forming the top side, while the other arm leg projects vertically downwards. The countertop or washbasin can be placed on the upper support leg, which, along with the horizontally offset second support element, forms the fastening plane, and then screwed to said support leg. This means that only identical parts are used in relation to the support elements in this case, which simplifies the design of the supporting structure still further. Alternatively, one leg may also be wider than the other, wherein no identical parts are used in this case, but the support elements carrying the countertop or the washbasin are slightly different from the support elements carrying the linear guides.

The support arm legs are naturally provided with corresponding openings, whether they are holes, elongated holes, or the like, to allow for a linear guide or the countertop and the washbasin, respectively, to be screwed on accordingly. As previously mentioned, it is particularly preferable for each of these support elements and angle elements, respectively, whether identical parts or different parts, to be made of metal or sheet metal, which allows for a particularly narrow design, while at the same time providing the necessary mechanical properties.

In a specific arrangement configuration of the support elements, it is conceivable for two support elements to be arranged on both sides of the support component in the upper region thereof, wherein a linear guide is arranged on the lower support element and the upper support element is used to receive the countertop or washbasin. A pair of support elements is therefore used in the region of the right and left support component edge or support panel edge in each case, preferably as identical components in the form of angle elements, as described. In this case, the two upper support elements or angle elements in each case are used to receive the washbasin or countertop, while the two lower elements are used to receive the linear guides for the drawer. In this case, if all support elements are preferably identical as previously described, support elements arranged above one another in each case are rotated through 90° in respect of one another, resulting in the corresponding leg alignment.

In order to further reinforce the arrangement of the support elements arranged above one another in each case of each pair of supports, a practical development of the invention envisages that a reinforcing element that connects the two support elements arranged above one another is provided, in addition, for fastening and screwing, respectively, to the support component and the support panel, respectively. This reinforcing element ultimately connects the two support arms to one another, so that a vertical support is also thereby realized. In this case, the reinforcing element may be a connecting panel fastened, or fastenable, to both support elements by means of suitable fastening elements, for example a screwed-on metal, wood, or plastic panel. Alternatively to this, this connecting panel can also be fastened to the support elements in a substance-bonded fashion, wherein, since the support elements are preferably made of metal, the connecting panel may also be a metal panel, which is welded on. This welding arrangement can be implemented in advance, meaning that the pair of support elements comes with the connecting panel as standard. Alternatively, adhesive bonding is also conceivable.

If a detachable connecting panel is provided, additional reinforcement can be achieved in that the detachably fastened, or fastenable, reinforcing panel has grooves associated with the two support elements, with which springs projecting from the support elements engage. In addition, an interlocking connection is realized via this groove-spring engagement which forms a further support plane. The springs of the support elements, which project from the respective support legs to the side, can be formed by suitable deformation during manufacturing, whereas the grooves are easily milled. Once the support elements have been assembled, all that is necessary is for the reinforcing panel to be arranged on the side, fitted onto the springs with the grooves, and finally screwed on.

If, as further provided by the invention, at least two pairs of support elements, which are provided with linear guides, are arranged on the support component in different horizontal planes, each pair of support elements can each receive a drawer; in other words, two drawers arranged above one another are provided in this configuration. The two drawers each have a base, a front panel, and side panels, wherein the front and side partial surfaces each form the exterior of the furniture. Since the two lower support elements can ultimately be fastened to the support component and the support panel, respectively, at any distance from the two upper support elements, their spacing, and therefore also the height of the second drawer, can be varied accordingly. The two drawers may be the same size, but the lower drawer may also be lower or higher than the upper drawer.

This possible spacing variation also allows for a gap to be left between the two drawers. So that the lower drawer is finally covered in the closed position, a practical development of the invention provides for at least one intermediate panel to be arranged on the support component, extending horizontally therefrom, which intermediate panel is arranged between the at least two drawers. This intermediate panel is located directly above the lower drawer, thereby covering it in the closed position. At the same time, it can also serve as a shelf for objects. This intermediate panel can of course be omitted if the two drawers are virtually directly vertically adjacent to one another.

In addition to the bathroom furniture itself, the invention also relates to a bathroom arrangement comprising the bathroom furniture described above, as well as a washbasin to be arranged directly on two support elements or a countertop to be arranged on two support elements, and also a washbasin to be arranged on the countertop.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
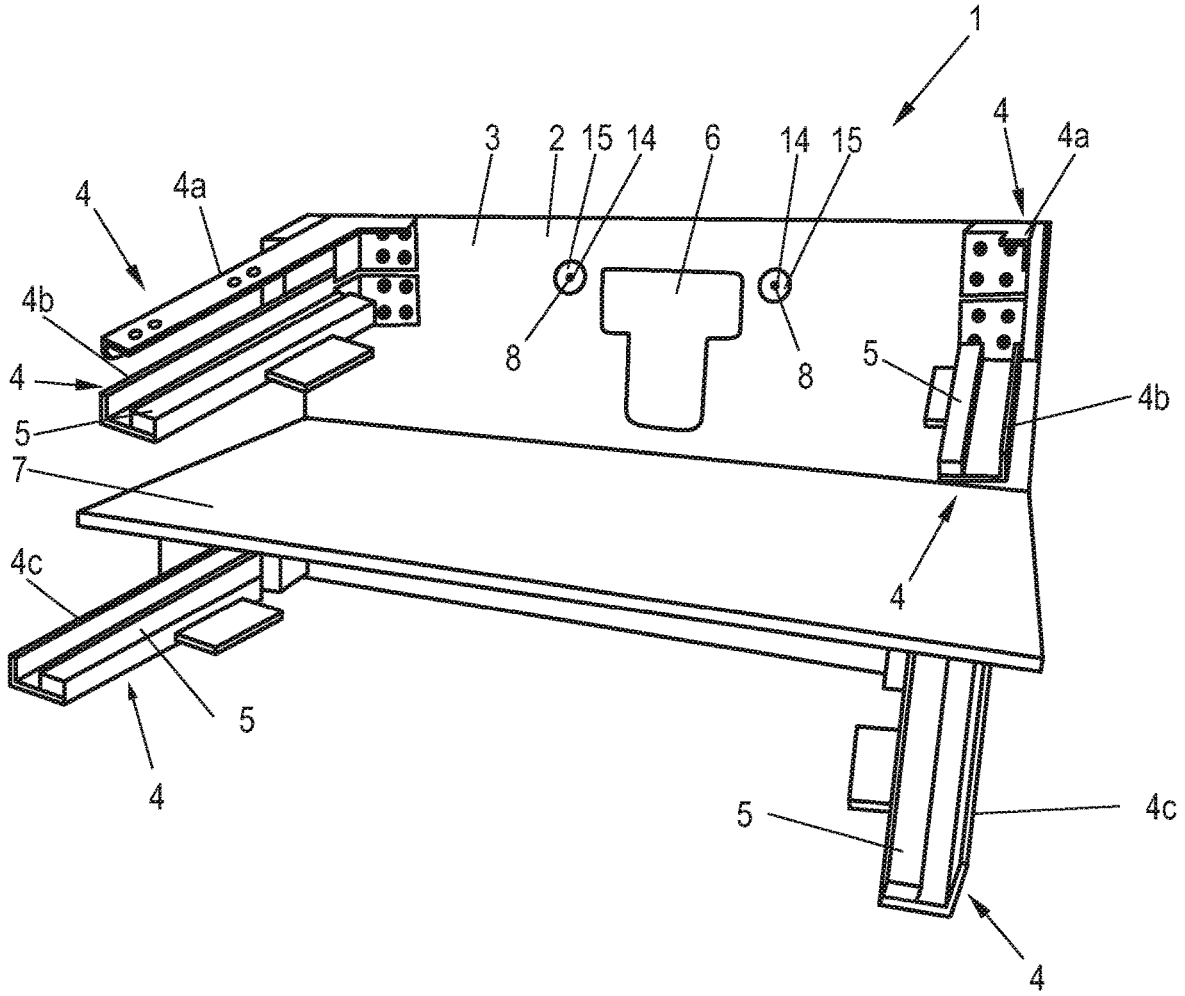
FIG. 1 shows a perspective schematic representation of a support structure of wall-mounted bathroom furniture according to the invention.

FIG. 1 shows a support structure 1 as part of bathroom furniture according to the invention to be wall-mounted. The support structure 1 comprises a support component 2 already mounted on the wall in the form of a support panel 3 with a larger area, and in the exemplary embodiment shown, a total of six separate support elements 4, which are fastened to the support panel 3, are screwed here. All support elements 4 are identical; they are angle elements which, depending on their application, are fastened to the support panel 3 only in different rotational positions. As will be explained in greater detail below, the two upper support elements **4*a* are used to receive a countertop or, alternatively, a washbasin directly, while the other support elements 4*b*, which are arranged directly below the support elements 4*a*, and the support elements 4*c*, each receive a linear guide 5**, on which corresponding drawers are arranged in each case, as will be explained in greater detail below.

Furthermore, the support panel 3 is provided with a correspondingly sized opening 6, through which corresponding water supply and drainage pipes are conducted to the fitted washbasin. Finally, an intermediate panel 7 is arranged on the support panel 3, which, as will also be explained in greater detail below, serves to cover the lower drawer arranged on the support elements 4*c*.

Figure 2:
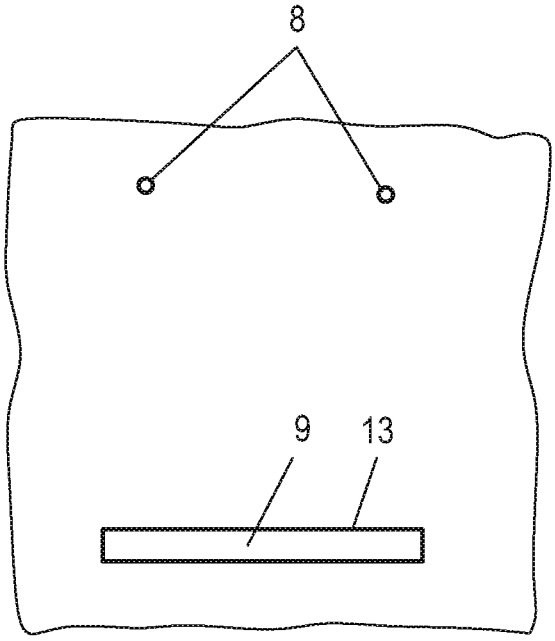
FIG. 2 shows a view of the wall before the arrangement of the support structure with lag screws arranged thereon and guide rail.

FIG. 1 shows the support structure 1 in its fixed position on the wall. For this purpose, as seen in FIGS. 2 and 3, two lag screws 8 are firstly provided on the wall side, and a guide rail 9 is also arranged on the wall side, which guide rail is aligned exactly horizontally and serves firstly to facilitate installation, but secondly also for ease of alignment of the support structure 1.

Figure 3:
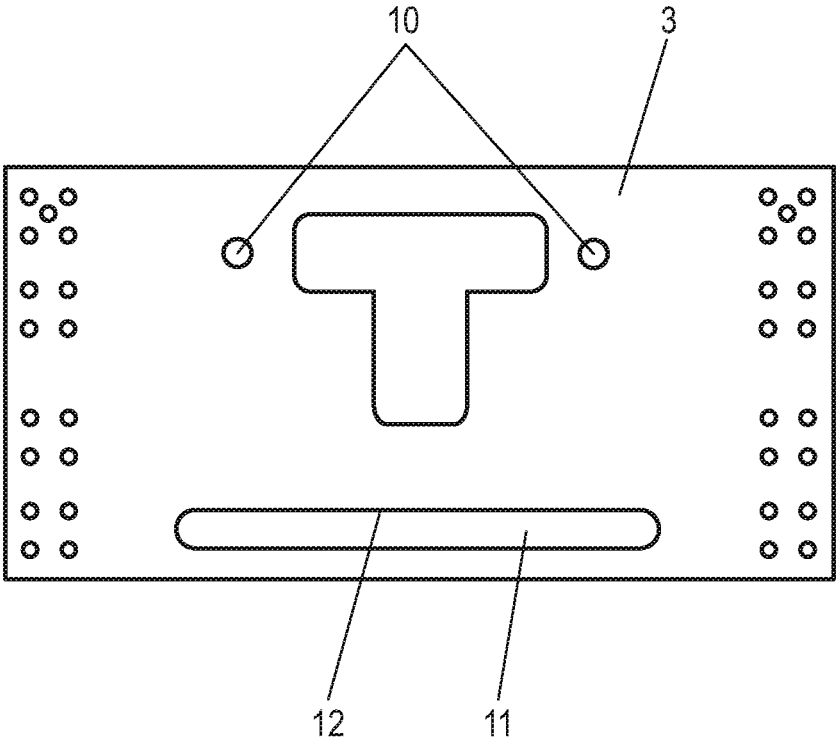
FIG. 3 shows a rear side view of the support panel of the support structure from FIG. 1.

The support panel 3, as shown in the rear side view from FIG. 3, is firstly provided with two openings 10, through which the two lag screws 8 pass and which are correspondingly oversized, so that there is scope for some alignment. Furthermore, a depression 11 is provided on the rear side, which is designed as an elongate depression and is introduced by simply milling into the rear side of the support panel 3 which is made of wood in this case. As described in greater detail below, this depression 11 engages with the guide rail 9 which is shorter by comparison.

For installation, the support structure 1 shown in FIG. 1 is slid onto the lag screws 8, which is very easily achievable due to the oversizing of the openings 10. The support panel 3 is pushed against the wall and initially positioned so that the guide rail 9 can engage with the depression 11. The support structure 1 can easily be lowered subsequently, allowing the upper edge 12 of the depression 11 to sit on the upper edge 13 of the guide rail 9. Since both edges 12 and 13 are rectilinear, the support structure 1 is therefore aligned exactly horizontally. A slight horizontal displacement is still possible for alignment purposes, within the limits allowed by the oversized openings 10. For final installation on each lag screw 8, a nut 14 along with a washer 15 is then screwed onto each lag screw 8, finally fastening the support structure 1.

Figure 4:
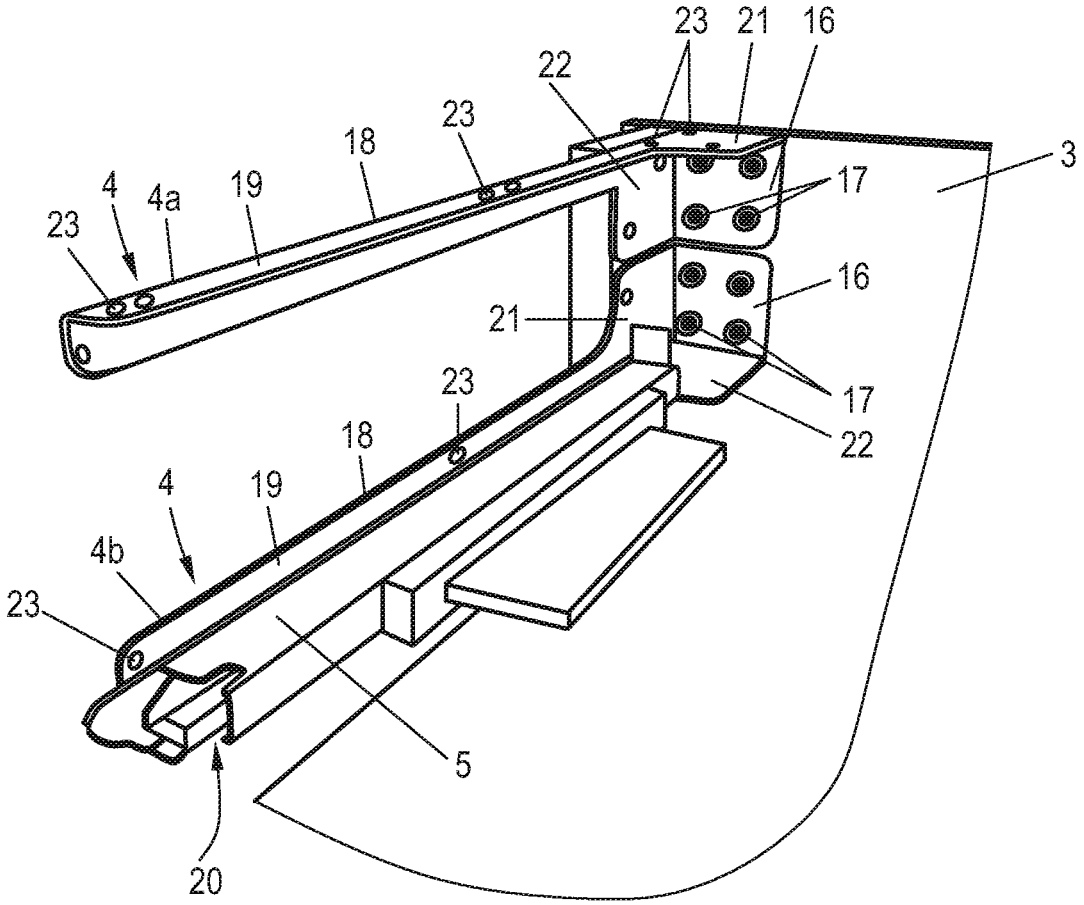
FIG. 4 shows an enlarged partial view of the support structure from FIG. 1 depicting two support elements.

FIG. 4 provides an enlarged view of the upper left region of the support structure 1 from FIG. 1, with the two support elements 4 and 4*a*, 4*b*, respectively, shown as an enlarged representation. Each support element 4 has a panel-shaped fastening section 16 with corresponding openings, through which corresponding fastening screws 17 engage for fastening to the support panel 3. Extending from each fastening section 16 is a support arm 18, comprising a first leg 19 and a second leg 20 in each case, which run perpendicularly to one another and which (optionally) are attached to the respective fastening section 17 via correspondingly widened leg sections 21, 22. Each leg 19, 20 and leg section 21, 22, respectively, is provided with openings 23 through which fastening screws pass for assembly of the corresponding attachments.

Figure 5:
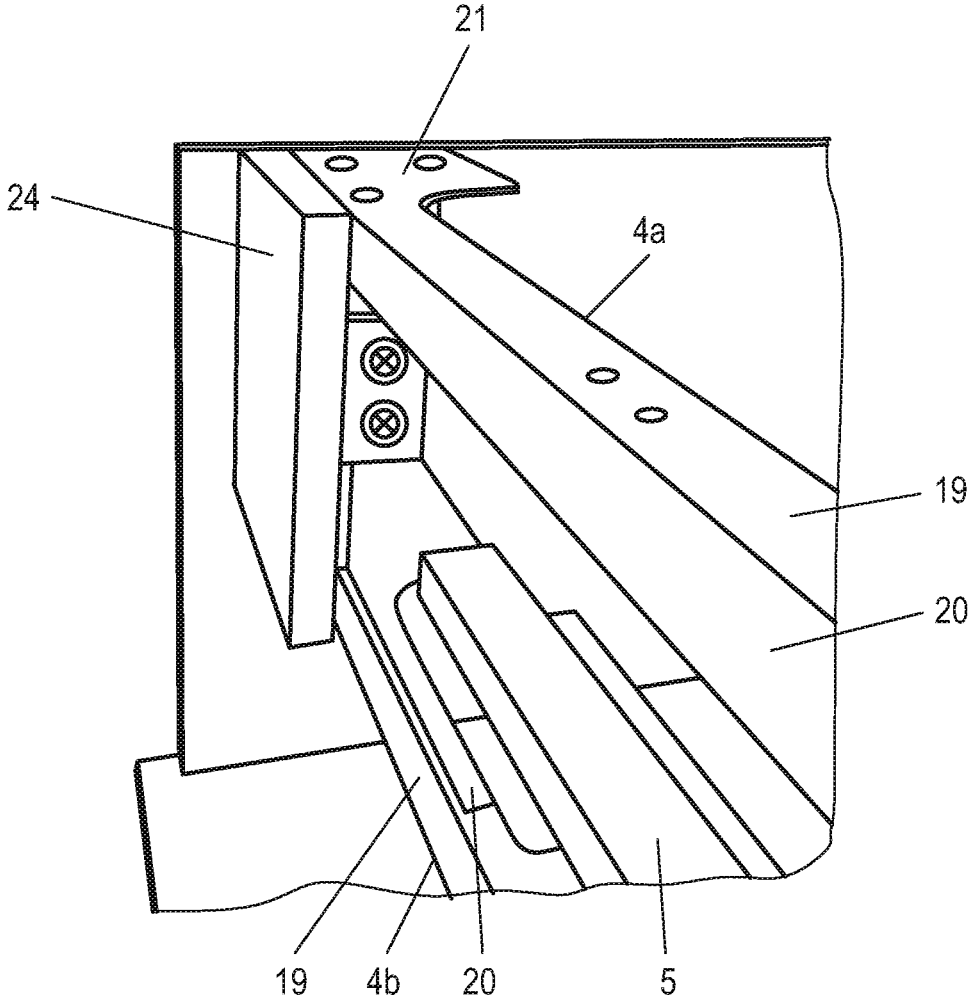
FIG. 5 shows the arrangement from FIG. 4 in a perspective view from the other side.

As shown in FIG. 4, but also in FIG. 5, the two support elements 4*a*, 4*b* (the same applies to the support elements 4*c*) are identical in design. The support elements 4*a* and 4*b* are simply rotated about 90° in respect of one another. This means that the leg 19 of the support element 4*a* is horizontally on the top side, while the leg 20 of the support element 4*a* projects vertically downwards. Since the support element 4*b* is rotated about 90° thereto, the leg 19 runs vertically upwards, while the leg 20 runs horizontally on the underside and visibly supports the linear guide 5. As described earlier, the two upper support elements 4*a* serve to receive a console-like countertop or, alternatively, directly the washbasin itself, in other words, these attachments rest on the legs 19 and, insofar as they are provided, the leg sections 21, and are fastened or screwed thereto. The drawer is arranged below this and guided via the linear guides of the two support elements 4*b*.

Figure 6:
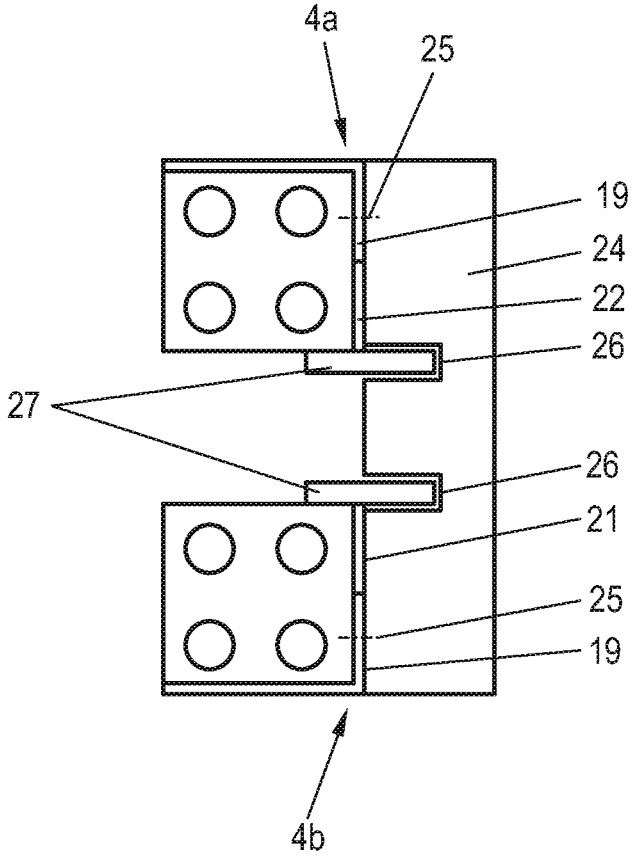
FIG. 6 shows an enlarged partial view of two support elements with this connecting reinforcing panel.

FIG. 5 shows a detail of the arrangement from FIG. 4 from the other side. A reinforcing panel 24 is shown, which connects the two support elements 4*a*, 4*b* to one another. Corresponding fastening screws 25, as shown in FIG. 6, are used for this purpose, by means of which the respective leg 20 of the support element 4*a* and 19, respectively, of the support element 4*b* are screwed thereto. In addition, but optionally, in the example shown, grooves 26 are provided on the reinforcing panel 24, with which corresponding springs 27, which are arranged on the respective leg section 22 of the support element 4*a* and 21, respectively, of the support element 4*b* engage. This provides further support and reinforcement. As described, the grooves 26 and the springs 27 are optional. If they are not provided, the support elements 4 and 4*a*, 4*b*, 4*c*, respectively, are identical components which are all executed in the same way. However, if springs are to be provided thereon, they are to be designed at the appropriate position, implying the need for two different sets of support elements.

The support elements 4 or 4*a*, 4*b*, 4*c* are preferably metal components produced from a suitable sheet metal through forming processes. This allows them to have correspondingly narrow dimensions, in other words, the respective support arms 18 and their legs 19, 20 can be executed in a correspondingly narrow and delicate manner, while still maintaining sufficient mechanical stability to support the corresponding attachments. The wide panel-shaped fastening sections 16 and the multiple fastenings already provide a sufficiently stable fixing to the countertop 3 which, as indicated in FIG. 3, has corresponding openings to receive the fastening screws for this purpose. Additional reinforcement is provided by arranging the reinforcing panel 24, for example a wooden or plastic panel which, moreover, can also be additionally screwed from the countertop side on the rear side.

Figure 7:
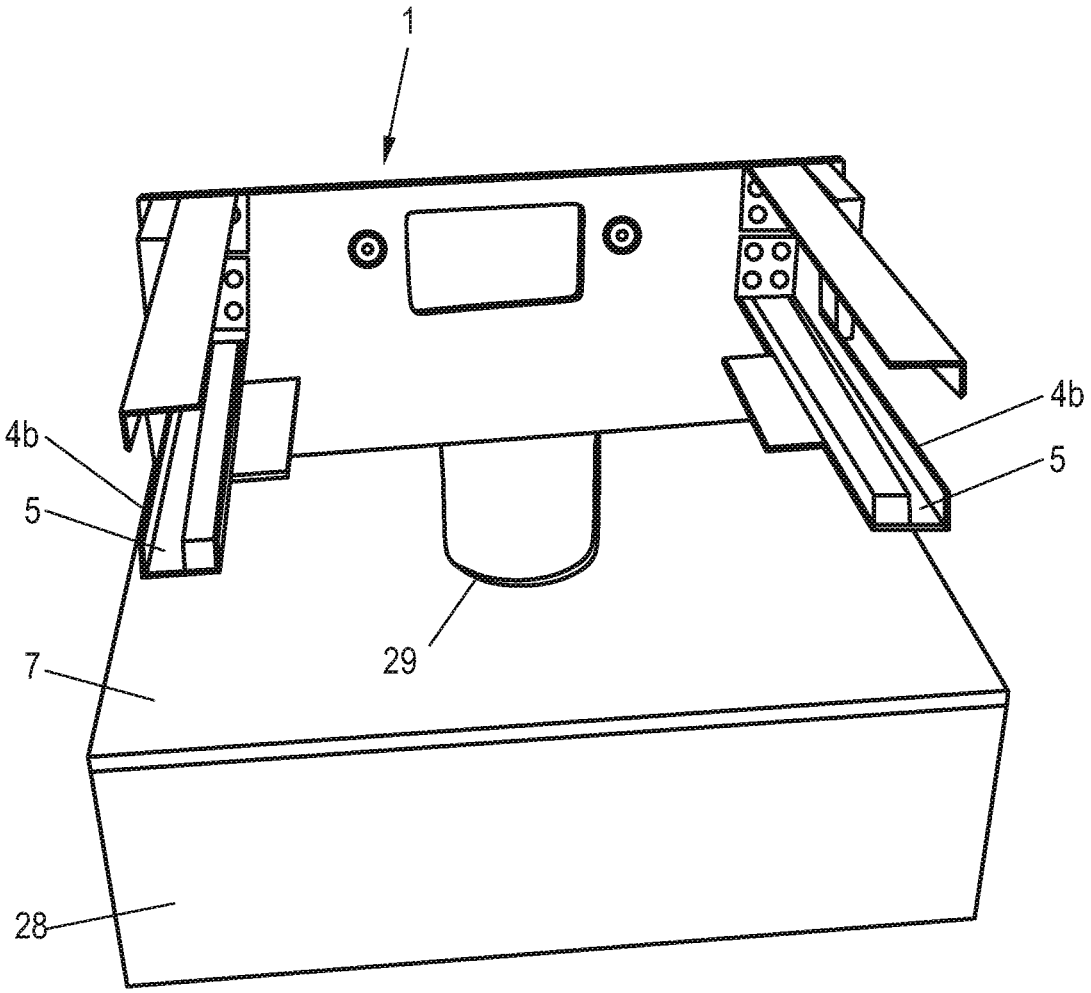
FIG. 7 shows the support structure from FIG. 1 with the lower drawer inserted.

FIG. 7 shows the support structure 1, wherein a drawer 8 is placed on the two lower support elements 4*c* and the linear guides 5 thereof, respectively, and fastened thereto. The front side of the drawer front can be seen to form the visible surface there and the two side walls of the drawer form the lateral visible surfaces. The intermediate panel 7 closes the drawer 28 in the closed position flush with the upper side. To conceal the water supply and drainage lines and pipes, respectively, a covering element 29 is shown here, which sits on the intermediate panel 7.

Figure 8:
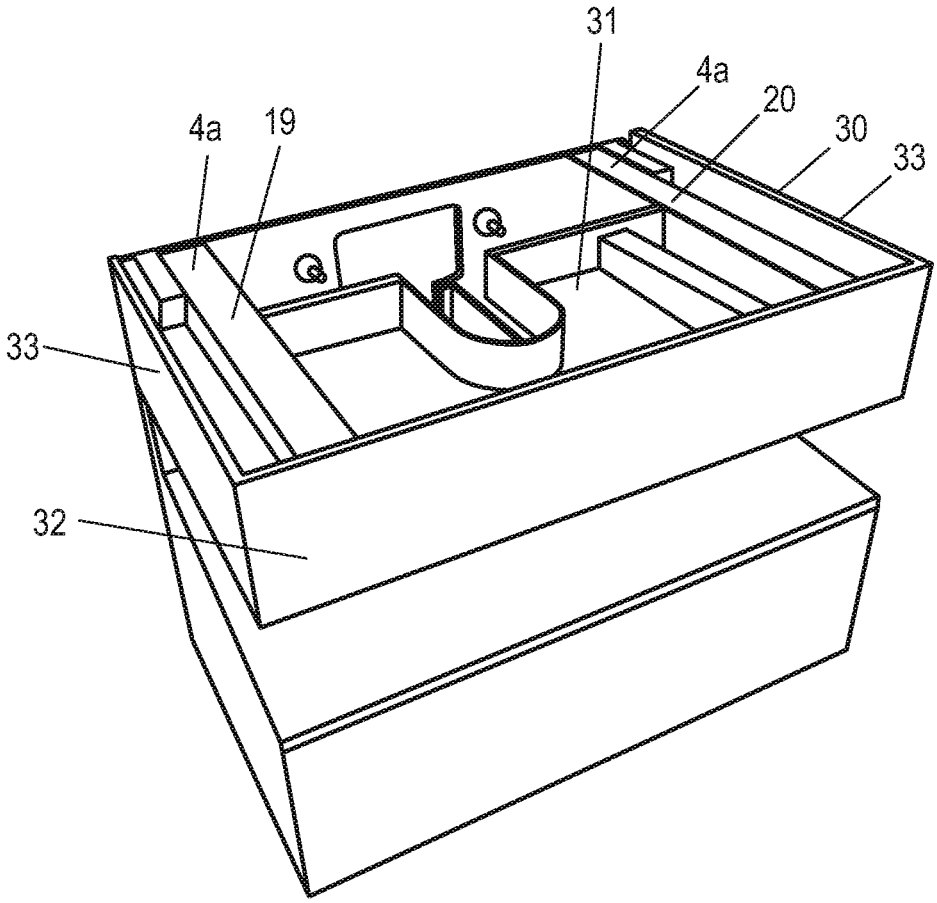
FIG. 8 shows the arrangement from FIG. 7 with the upper drawer inserted.

Subsequently, as shown in FIG. 8, an upper drawer 30 is placed on the linear guides 5 of the two support elements 4*b* and screwed to the linear guides 5. The drawer 30, as well as the drawer 28, has a base 31, a front wall 32 and two side walls 33, wherein the drawer 30 (the same applies to the drawer 28) sits with the base 31 on the linear guides 5 and is attached, particularly screwed or clipped, thereto. The linear guides 5 are therefore underfloor runners.

The height of the drawer 30 is of such dimensions that its upper edge ends slightly below the two legs 19, 20 of the two support elements 4*a*. A flush closure is also possible.

Figure 9:
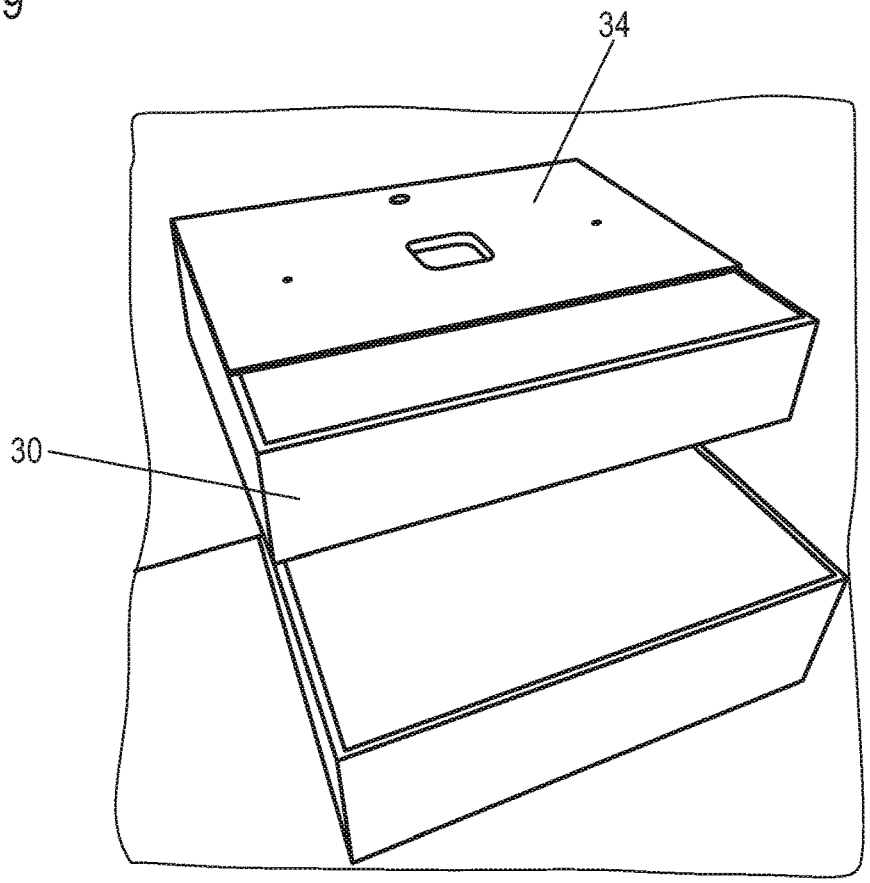
FIG. 9 shows the arrangement from FIG. 8 with the countertop placed on the upper support elements.

As shown in FIG. 9, a countertop 34 is then placed on the two support elements 4*a* and the two upper legs 19, 20 thereof, respectively, the underside whereof is spaced slightly away from the upper edge of the drawer 30. If the drawer 30 ends slightly below the legs 19, 20, there is sufficient clearance. If it ends flush with the legs 19, 20, a corresponding assembly height increase should be provided on the underside of the countertop 34, which sits on the legs 19, 20. The bathroom furniture is fully assembled with the placement of the countertop 34, at the latest.

Figure 10:
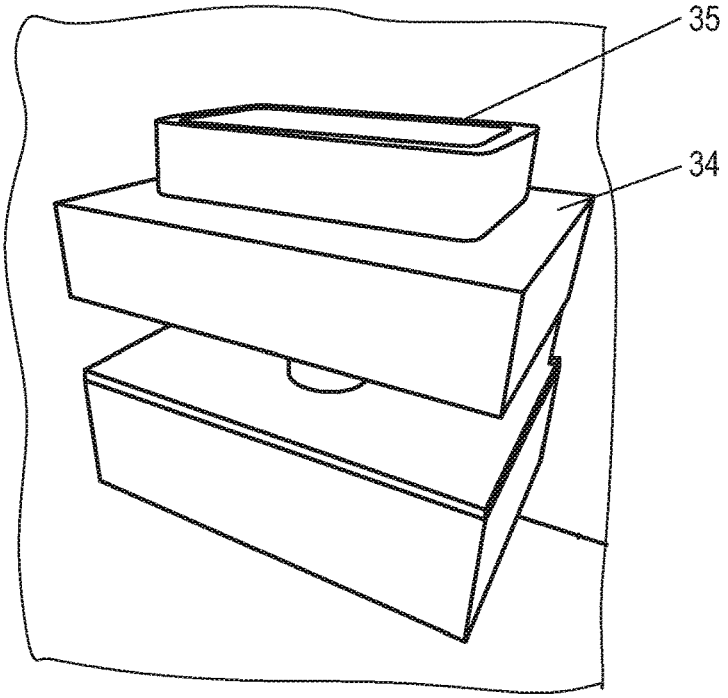
FIG. 10 shows a bathroom arrangement according to the invention comprising the inventive bathroom furniture and a mounted washbasin.

All that is then required, as shown in FIG. 10, is for the washbasin 35 to be placed on the console-like countertop 34 and attached thereto in an appropriate manner, meaning that installation of the bathroom arrangement is complete.

In the exemplary embodiment shown in FIGS. 7 to 10, the guide rails 4 are not identical parts, as shown in the example according to FIGS. 1 to 5. As shown in FIG. 7, in particular, the legs 19, 20 have different lengths, thereby finally providing larger support surfaces for the linear guides 5 and the countertop 34, respectively, or, when directly mounted, the washbasin 35.

Instead of the configuration shown in FIGS. 9 and 10, it is also conceivable to place the washbasin 35 directly on the support elements 4*a* and fasten it thereto, eliminating the need for the countertop 34. This, of course, assumes that the washbasin 35 has corresponding side sections which completely cover the drawer 30 located below them.

Finally, it should be noted that the intermediate panel 7 need not necessarily be provided. In the example shown, it creates a corresponding space between the two drawers 28 and 30, wherein the intermediate panel 7 also acts as a shelf. If a gap of this kind is not desired, it is easily possible to position the two lower support elements 4*c* higher, so that the lower drawer 28 is arranged directly adjacent to the upper drawer 30.

While specific embodiments of the invention have been shown and described in detail to illustrate the inventive principles, it will be understood that the invention may be embodied otherwise without departing from such principles.

We claim:

1. A wall-mounted bathroom furniture, comprising a supporting structure with a support component fastenable to a vertical wall and multiple support elements arranged offset horizontally to one another on the support component, projecting horizontally from said support component in cantilever fashion, wherein linear guides for receiving at least one extendable drawer are provided on the support elements or on at least some of the support elements, at least one drawer with a base, two side walls and a front wall that is placed on the linear guides arranged below the base, wherein the support elements, or at least some of the support elements, are configured either to receive a countertop arranged horizontally, for receiving a washbasin, or to directly receive a washbasin.

2. The bathroom furniture according to claim 1, wherein at least two openings for receiving lag screws are provided on the support component.

3. The bathroom furniture according to claim 1, wherein the support component is a support plate.

4. The bathroom furniture according to claim 3, wherein on the support plate an elongate opening or depression extending horizontally in relation to an assembly position, for receiving a guide rail, is provided, on which the support panel sits in the assembly position.

5. The bathroom furniture according to claim 1, wherein each support element has a plate-shaped fastening section for connection to the support component and a support arm extending perpendicularly from the fastening section to receive a linear guide or the countertop or the washbasin.

6. The bathroom furniture according to claim 5, wherein the support arm is L-shaped in cross section.

7. The bathroom furniture according to claim 6, wherein two support elements are arranged on both sides of the support component in an upper region thereof, wherein a linear guide is arranged on a lower of the support elements and an upper of the support elements is used to receive the countertop or washbasin.

8. The bathroom furniture according to claim 1, wherein the support elements are all identical, wherein two support elements arranged above one another are arranged rotated about 90° in respect of one another.

9. The bathroom furniture according to claim 7, wherein the two support elements arranged above one another are connected to one another via a reinforcing element.

10. The bathroom furniture according to claim 9, wherein the reinforcing element is a reinforcing panel fastened, or fastenable, to both support elements by means of fastening elements or fastened thereto by cohesion.

11. The bathroom furniture according to claim 10, wherein the reinforcing panel has grooves associated with the two support elements, with which springs projecting from the support elements engage.

12. The bathroom furniture according to claim 1, wherein at least two pairs of support elements, which are provided with linear guides, are arranged on the support component in different horizontal planes, wherein each pair of support elements receives a drawer.

13. The bathroom furniture according to claim 12, wherein at least one intermediate panel is mounted to extend horizontally from support component, the intermediate panel being arranged between the at least two drawers.

14. A bathroom arrangement comprising: a bathroom furniture according to claim 1: and a washbasin arranged directly on two support elements or a countertop arranged on the two support elements and a washbasin arranged on the countertop.

* * * * *